US005265889A

United States Patent [19]

Kojima

[11] Patent Number: 5,265,889

[45] Date of Patent: Nov. 30, 1993

[54] DRIVE GAME APPARATUS

[75] Inventor: Shizuka Kojima, Tokyo, Japan

[73] Assignee: Tomy Company, Ltd., Tokyo, Japan

[21] Appl. No.: 837,207

[22] Filed: Feb. 18, 1992

[30] Foreign Application Priority Data

Feb. 19, 1991 [JP] Japan ..... 3-014302[U]

[51] Int. Cl.[5] ..... A63F 9/14

[52] U.S. Cl. ..... 273/442; 273/85 R; 273/86 B; 273/86 G; 273/86 H

[58] Field of Search ..... 273/441, 442, 440, 85 R, 273/86 R, 86 B, 86 F, 86 G, 86 H; 434/62

[56] References Cited

U.S. PATENT DOCUMENTS

| | | | |
|---|---|---|---|
| 3,171,215 | 3/1965 | Glass et al. | 273/442 X |
| 3,819,178 | 6/1974 | Ochi | 273/441 |
| 4,231,571 | 11/1980 | Watanabe | 273/441 X |
| 4,279,417 | 7/1981 | Yokoi | 273/442 |
| 4,352,493 | 10/1982 | Watanabe | 273/442 |
| 5,062,647 | 11/1991 | Chanter et al. | 273/442 |

*Primary Examiner*—V. Millin
*Assistant Examiner*—Raleigh W. Chiu
*Attorney, Agent, or Firm*—Staas & Halsey

[57] ABSTRACT

The drive game apparatus of the present invention includes a belt-like sheet having obstacles drawn thereon and having each end connected to each of a pair of take-up rolls, and a driving source for use in moving the belt-like sheet between the pair of take-up rolls. In addition, the invention includes a moving member carriage having a projection arranged at a rear surface thereof and having this projection biased to be lightly pressed onto the surface of the belt-like sheet, and a moving member operating part for reciprocating the moving member carriage in a lateral direction. The belt-like sheet is formed with engaging portions corresponding to the obstacles and at the same time a location below the extreme end of the moving member carriage is formed with another engaging portion which can be engaged in correspondence with the aforesaid engaging portions. Since not only the moving member can be moved, but also a traffic trouble can be produced during the movement of the moving member, a player can enjoy a more thrilling experience while operating the drive game apparatus.

10 Claims, 7 Drawing Sheets

DRIVE GAME APPARATUS

BACKGROUND OF THE INVENTION

1. Field of the Invention

This device relates to a drive game apparatus.

2. Description of the Related Art

As a prior art drive game apparatus, it is known to provide an apparatus described in Jap. U.M. Publn. No. Sho 55-41267, for example.

This drive game apparatus is operated such that a belt-like sheet tensioned between a pair of take-up rolls is moved to cause an automobile (a moving member) to run on a road drawn on a belt-like sheet. The operator selects a branched road by operating a handle.

However, in the drive game apparatus as described in the prior art, although an interesting feeling or experience of selecting the branched road or the like is obtained by the operator, the prior art lacks a more thrilling experience due to the fact that the automobile is merely run on the road drawn on the belt-like sheet or the like.

SUMMARY OF THE INVENTION

It is, therefore, an object of the present invention to provide a drive game apparatus through which a player can enjoy a thrilling experience.

The drive game apparatus according to the present invention includes a belt-like sheet having obstacles drawn therein and having each end thereof connected to a pair of take-up rolls, and a driving source for use in moving the belt-like sheet between the pair of take-up rolls. In addition, the invention includes a moving member carriage having a projection arranged at a rear surface thereof and biased to cause the projection to be lightly pushed onto a surface of the belt-like sheet, and a moving member operating part for use in reciprocating the moving member carriage in a lateral direction. The belt-like sheet is formed with engaging portions corresponding to the obstacles and at the same time the moving member carriage is formed with the projection which can be engaged with the engaging portions.

According to the above-mentioned means, not only the moving member can be moved, but also a certain trouble or accident can be produced during the moving of the moving member. Accordingly, a more thrilling experience can be felt by a player as compared with the prior art drive game apparatus.

In addition, according to the aforesaid means, the trouble can be generated under a mere engagement between the engaging portions in the belt-like sheet and an engaging portion or projection of the moving member carriage, so that even if a mechanism for producing the aforesaid trouble is newly added, the entire apparatus is not complicated.

DESCRIPTION OF THE PREFERRED EMBODIMENTS

Figure 1:
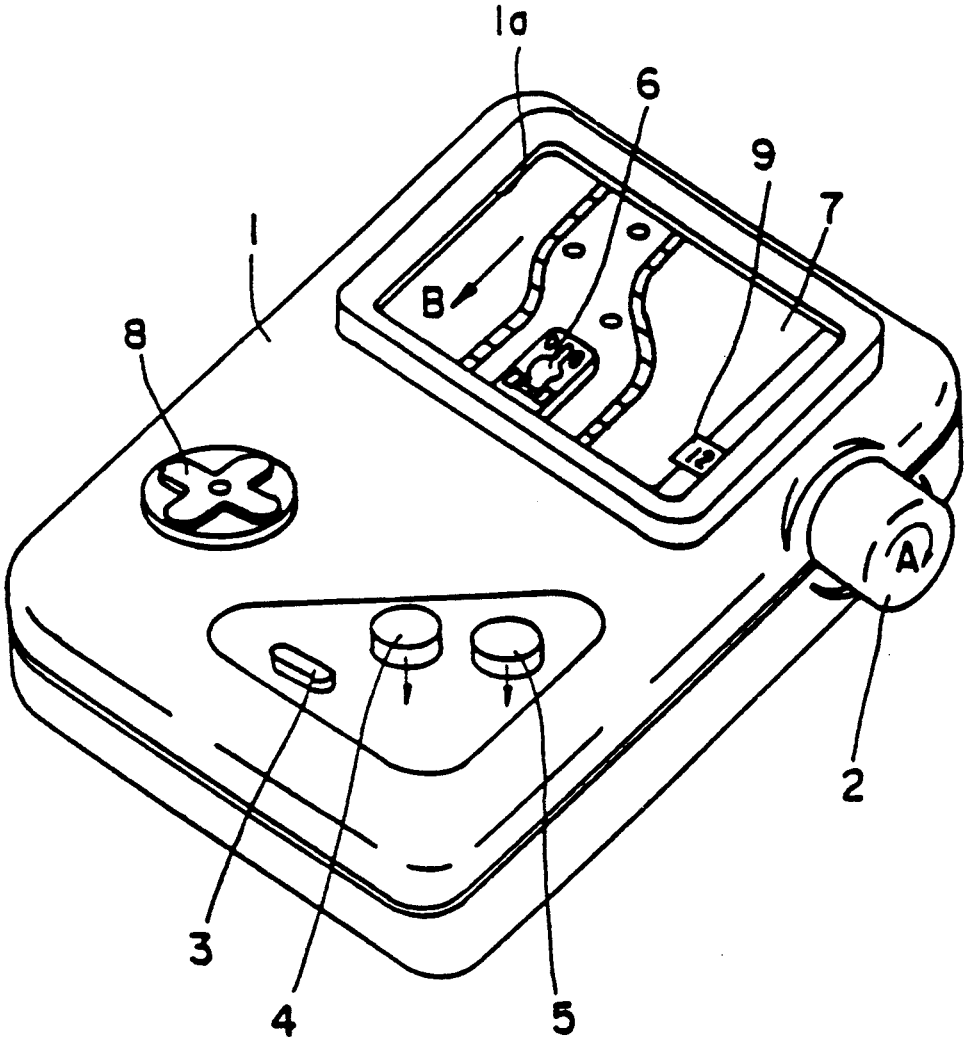
FIG. 1 is a front perspective view showing a drive game apparatus of the first preferred embodiment.

Referring now to the drawings, some preferred embodiments of the drive game apparatus of the present invention will be described. At first, an operation of the drive game apparatus of the present preferred embodiment will be described with reference to FIG. 1. A game performed through the drive game apparatus of the preferred embodiment is started by rotating a take-up knob 2 positioned at the right side surface of a main body 1 in the direction of arrow A as viewed in FIG. 1 and then pushing start button 3. Once the game is started, a belt-like sheet 7 having pictures such as roads or other obstacles (hereinafter called obstacles) drawn thereon is moved within window 1*a* of the main body in the direction of arrow B as viewed in FIG. 1. Since an automobile or other moving member 6 which a player must operate is not moved in a direction parallel to the belt-like sheet 7 with respect to the main body 1, the player feels as if the moving member 6 runs on the road or belt-like sheet.

The player may properly press the moving member operating buttons 4 and 5 (the moving member operating part) to cause the moving member 6 to move in opposite lateral directions perpendicular to the direction which the belt-like sheet moves to avoid the obstacles. If the moving member 6 strikes against the obstacles, the moving action of the belt-like sheet 7 is stopped, so that the player feels as if the moving member 6 by itself has encountered a trouble condition or accident.

The drive game apparatus according to this preferred embodiment may be scored in terms of distance traveled in a predetermined time interval by placing increasing numbers along the side of the belt-like sheet 7 exposed by a point display part within the window 1*a* of the main body through the aforesaid operation. In addition, the drive game apparatus of this preferred embodiment is provided with a speed changing button 8 protruding through the top surface of the main body 1, and the moving speed of the belt-like sheet 7 can be changed or varied by depressing the speed changing button 8.

Figure 2:
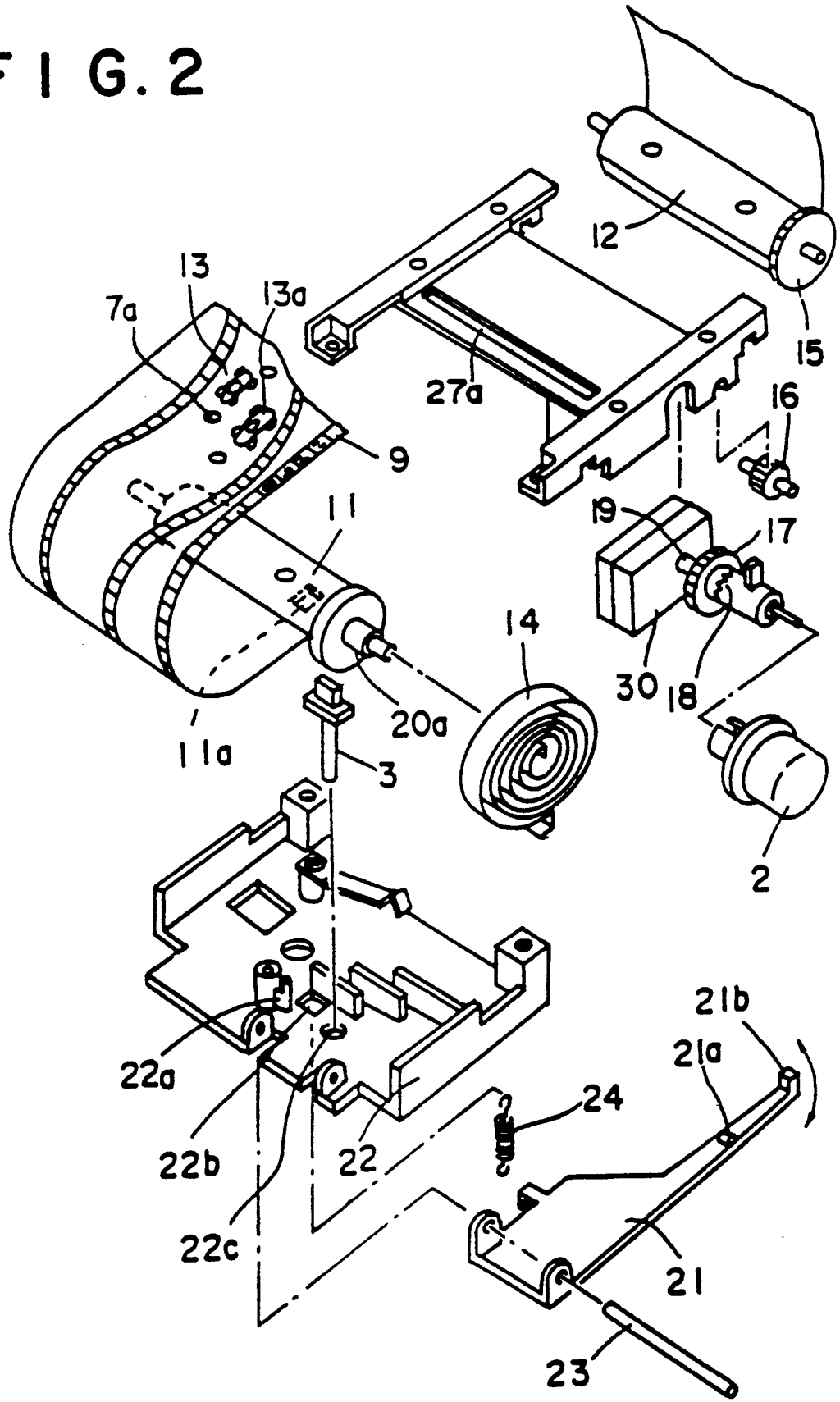
FIG. 2 is an exploded perspective view showing a part of the drive game apparatus of the first preferred embodiment.

A practical configuration of the drive game apparatus of the preferred embodiment will now be described with reference to FIG. 2. As shown in FIG. 2, each of the end portions of the belt-like sheet 7 is connected to each of the take-up rolls 11 and 12, and they as a whole constitute one cartridge or unit. Accordingly, with a plurality of cartridges having different patterns drawn on the belt-like sheet 7, the player can enjoy different games by replacing the cartridges.

On the upper surface of the belt-like sheet 7 is drawn, for example, a road 13 acting as a running passage for the moving member 6 and further within the road 13 are shown an automobile 13*a* and other obstacles. In turn, a point display part 9 is provided on the side or edge of the belt-like sheet 7. A portion on the belt-like sheet before each of the obstacles 13*a* has engaging holes (engaging portions) 7*a*.

A spring (a driving source) 14 is fixed to one end of the take-up roll 11. In turn, the take-up roll 12 is connected to the take-up knob 2 through gears 15, 16, 17 and a clutch 18. When the take-up knob 2 is rotated in a direction, for example, as indicated by arrow A as seen in FIG. 1, the belt-like sheet 7 is wound around the take-up roll 12, thereby rotating the take-up roll 11. When take-up roll 12 is rotated, spring 14 is wound creating a resilient energy stored in the spring 14. As shown in FIG. 2, a hole 20*a* formed in the take-up roll 11 is a hole for use in engaging the inner end of the edge of the spring 14.

Figure 6:
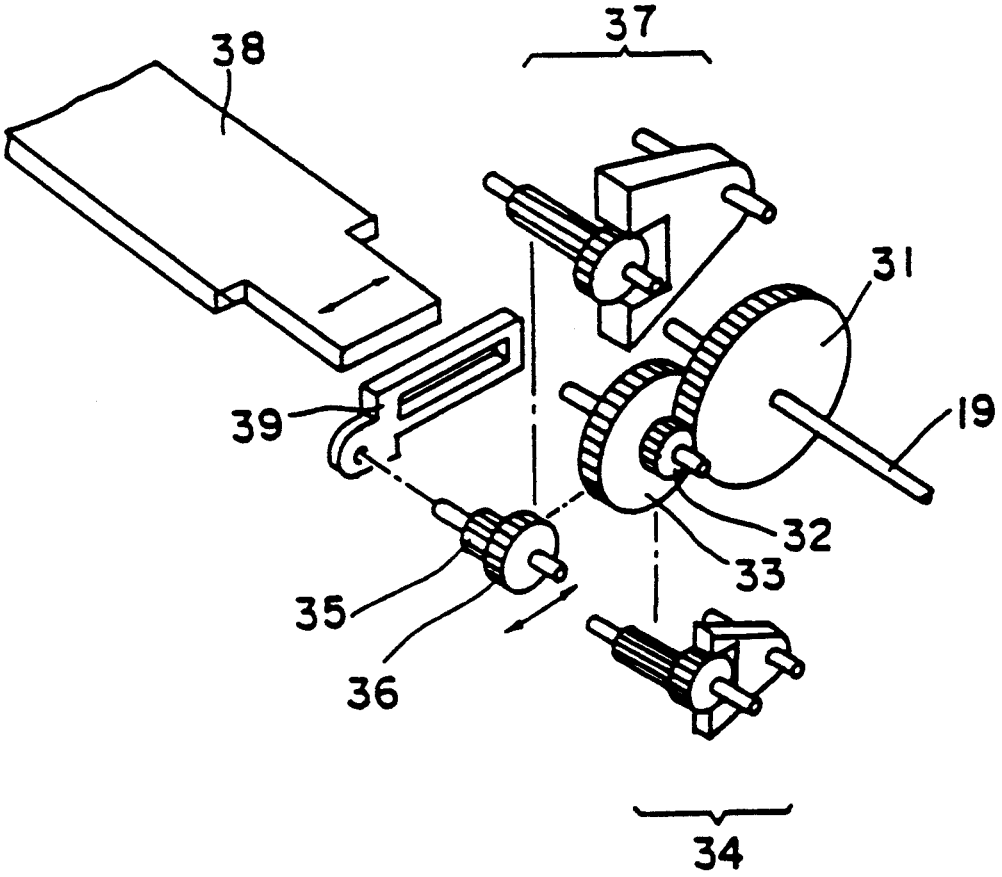
FIG. 6 is an exploded perspective view showing a part of each of the speed governor mechanism and the speed changing mechanism in the drive game apparatus of the first preferred embodiment.

In addition, when the take-up knob 2 is rotated in the direction of arrow A as viewed in FIG. 1, its rotated or wound-up state is maintained until the start button 3 is depressed under an arrangement of a stopper plate 21. This stopper plate 21 is arranged below a fixing plate 22 in such a way that it may be oscillated in a vertical direction around a shaft 23. A free end of the stopper plate 21 is provided with projections 21*a* and 21*b*. A spring 24 is tensioned through an opening 22*b* of the fixing plate 22 between the stopper plate 21 and a fixing part 22*a* of the fixing plate 22. When the belt-like sheet 7 is fully wound on the take-up roll 12 by the take-up knob 2, the projection 21*a* is engaged with fitting hole 11*a* of the take-up roll 11 under a biasing force of spring 24. At this time, the projection 21*b* is also engaged with either a gear within gear box 30 or a governor mechanism as shown in FIG. 6. Thus, moving of the belt-like sheet 7 caused by the rotating of the take-up roll 12 is prevented.

Figure 3:
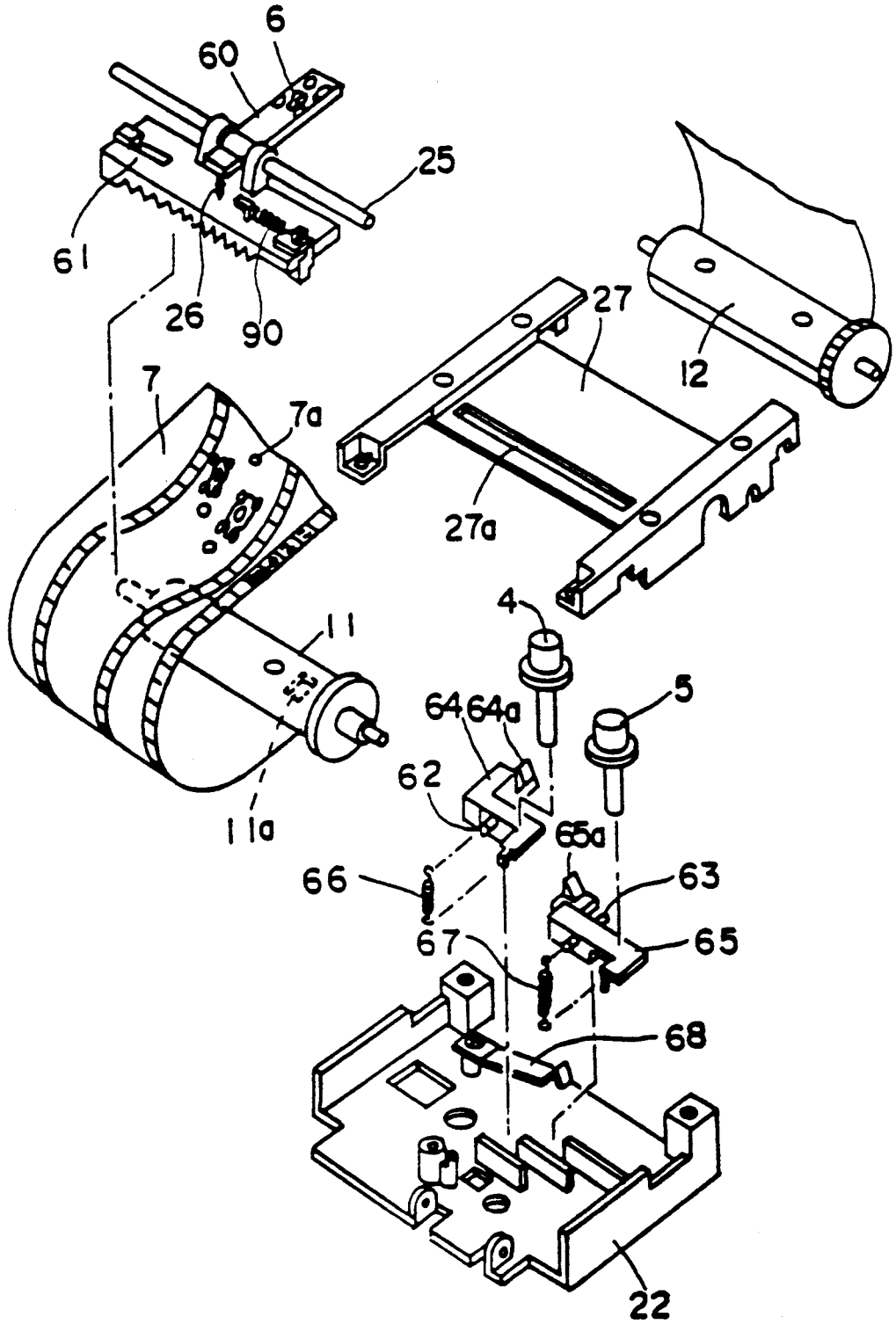
FIG. 3 is an exploded perspective view showing a part of the drive game apparatus of the first preferred embodiment.

The shaft end of the start button 3 is abutted against the top surface of the stopper plate 21 constructed as described above through the hole 22*c* of the fixing plate 22. Accordingly, when the start button 3 is operated, the stopper plate 21 is oscillated around the shaft 23 against a biasing force of the spring 24, thereby an engagement or lock between the fitting hole 11*a* and the projection 21*a* is released. Once the lock is released, the belt-like sheet 7 is wound around the take-up roll 11 under the releasing or unwinding force of the spring 14. As shown in FIG. 3, on the belt-like sheet 7 within the main body 1 is mounted the moving member carriage 60 having the moving member 6 fixed and mounted in such a way that the carriage may be oscillated vertically around the shaft 25.

Figure 4:
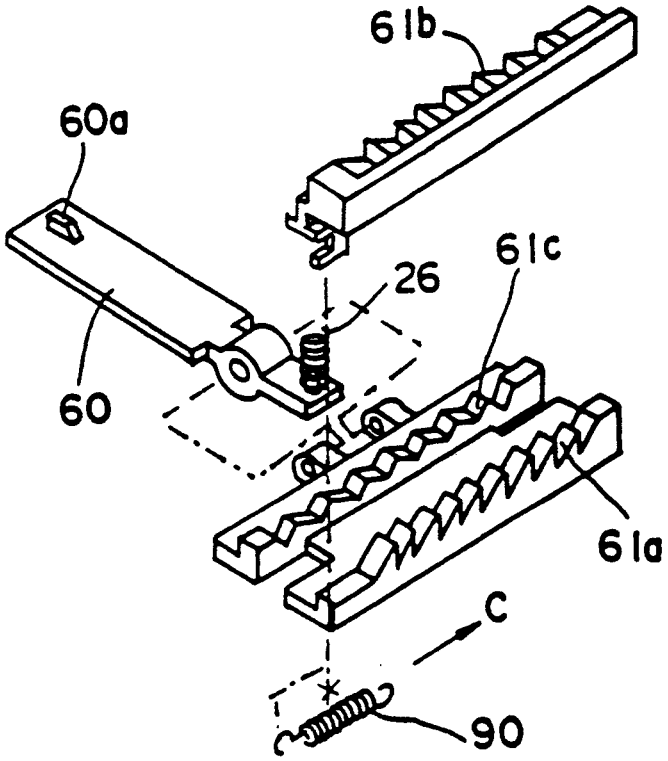
FIG. 4 is an exploded perspective view showing a moving member carriage of the drive game apparatus of the first preferred embodiment.

As shown in FIG. 4, a projection (an engaging part) 60*a* is arranged on the underside of the free end of the moving member carriage 60, which is shown in FIG. 3 with its right side up. The projection 60*a* of the moving member carriage 60 is lightly pressed onto the upper surface of the belt-like sheet 7 with a biasing force created by spring 26. In turn, at a location below the belt-like sheet 7 within the main body 1 is arranged a plate 27 shown in FIG. 3 for supporting the belt-like sheet 7 from its lower side. The supporting plate 27 is formed with a lateral-elongated rectangular concave part 27*a*. A forming position of this concave part 27*a* corresponds to an arranging position of the projection 60*a* in FIG. 4. When the projection 60*a* is engaged with the engaging hole 7*a* of the belt-like sheet 7, the concave part 27*a* and the projection 60*a* are engaged to each other through the engaging hole 7*a*. A movement of the belt-like sheet 7 is positively stopped under this engagement of the concave part 27*a* and the projection 60*a*. As shown in FIG. 4, the projection 60*a* has its extreme one end perpendicular to the moving member carriage 60 arranged vertically with respect to a rear surface of the moving member carriage 60 and in turn, has another end gradually inclined with respect to the rear surface of the moving member carriage 60. Accordingly, when the belt-like sheet 7 is moved from the take-up roll 12 to the take-up roll 11, the movement of the belt-like sheet 7 is stopped under by an engagement between the concave part 27*a* and the projection 60*a*. However, when the belt-like sheet 7 is moved from the take-up roll 11 to the take-up roll 12, the belt-like sheet 7 moves freely.

The shaft 25 of the moving member carriage 60 is fixed to sliding member 61 in such a way as it may be axially moved integrally with the moving member carriage 60. As shown in FIG. 4, teeth 61*a* and 61*b* are arranged in parallel at a rear surface of the sliding member 61. These teeth 61*a* and 61*b* can be engaged with each of claws 64*a* and 65*a* arranged at one end of each of lever members 64 and 65 which are oscillatable around the shafts 62 and 63, respectively. In addition, as shown in FIG. 4, mountain-shaped teeth 61*c* are formed at the rear surface of the sliding member 61 in parallel with the teeth 61*a* and 61*b*. The teeth 61*c* can be engaged with a leaf spring 68 fixed to the fixing plate 22 as shown in FIG. 3. In turn, the other ends of the level members 64 and 65 are abutted against axial lower ends of the moving member operating buttons 4 and 5 under biasing forces of the springs 66 and 67. Thus, it is possible to move the moving member 6 in a lateral direction by one pitch or notch in saw teeth 61*a* and 61*b* by depressing the moving member operating buttons 4 and 5. In addition, the teeth 61*b* are separately formed from the sliding member 61 and can be moved relatively in a lateral direction with respect to other teeth 61*a* formed at the sliding member 61 and at the same time teeth 61*b* are biased by a spring 90 in a direction indicated by an arrow C as viewed in FIG. 4. In the event that both moving member operating buttons 4 and 5 are depressed concurrently, they may prevent the teeth 61*a* and 61*b* from being damaged.

A speed adjusting mechanism is located within gear box 30 to which shaft 19 is fixed to gear 17 as shown in FIG. 2. As shown in FIG. 6, a large diameter gear 31 is fixed to the other end of shaft 19 which is located in gear box 30. A small diameter gear 32 is engaged with the large diameter gear 31. A large diameter gear 33 rotated together with the small diameter gear 32 is arranged concentrically with the small diameter gear 32. To this large diameter gear 33 is connected a small governor mechanism 34 and at the same time a large governor mechanism 37 is connected to large diameter gear 33 through intermediate gears 35 and 36. Normally, the large diameter gear 33 is connected directly or indirectly and concurrently with both small governor mechanism 34 and large governor mechanism 37.

Figure 5:
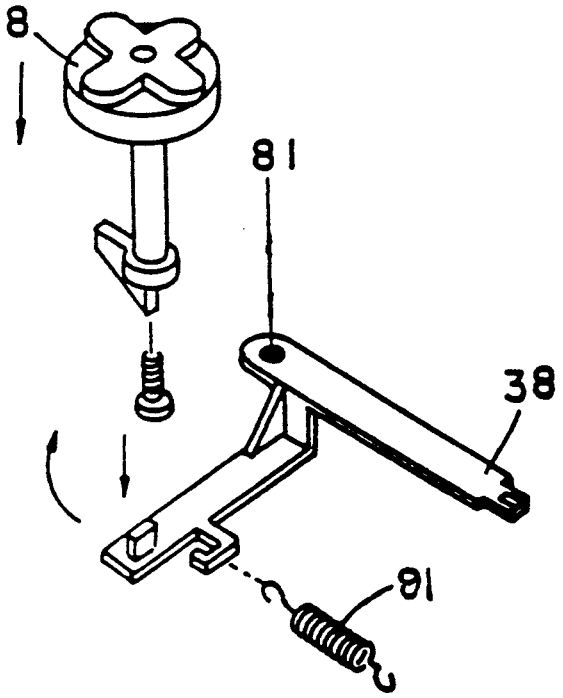
FIG. 5 is an exploded perspective view showing a part of a speed changing mechanism in the drive game apparatus of the first preferred embodiment.

The shaft of the intermediate gears 35 and 36 is fixed to a supporting plate 39 (FIG. 6) into which one end of an oscillating plate 38 is positioned. Plate 38 oscillates in a lateral direction around a shaft (now shown), through a hole 81 as the speed changing button 8 is pressed and operates integrally with the oscillating plate 38 shown in FIG. 5. Spring 91 biases plate 38 in a direction oposite the direction shown by the arrow. In this way, under a pressing operation of the speed changing button 8 in FIG. 5, the intermediate gears 35 and 36 connected to the large diameter gear 33 under normal conditions are released from the large diameter gear 33, thereby the connection between the large governor mechanism 37 and the large diameter gear 33 is released and thus the moving speed of the belt-like sheet 7 can be increased.

According to the drive game apparatus constructed as described above, the following advantageous effects can be attained. First, not only is the moving member 6 moved, but also traffic trouble may be generated during the movement of the moving member 6. Accordingly, a player can enjoy a more thrilling experience as compared with prior art drive game apparatus. Second, according to the drive game apparatus, the mere engagement of engaging hole 7*a* of the belt-like sheet 7 with the projection 60*a* of the moving member carriage 60 enables a traffic trouble to be generated without complicating the entire apparatus.

Figure 7:
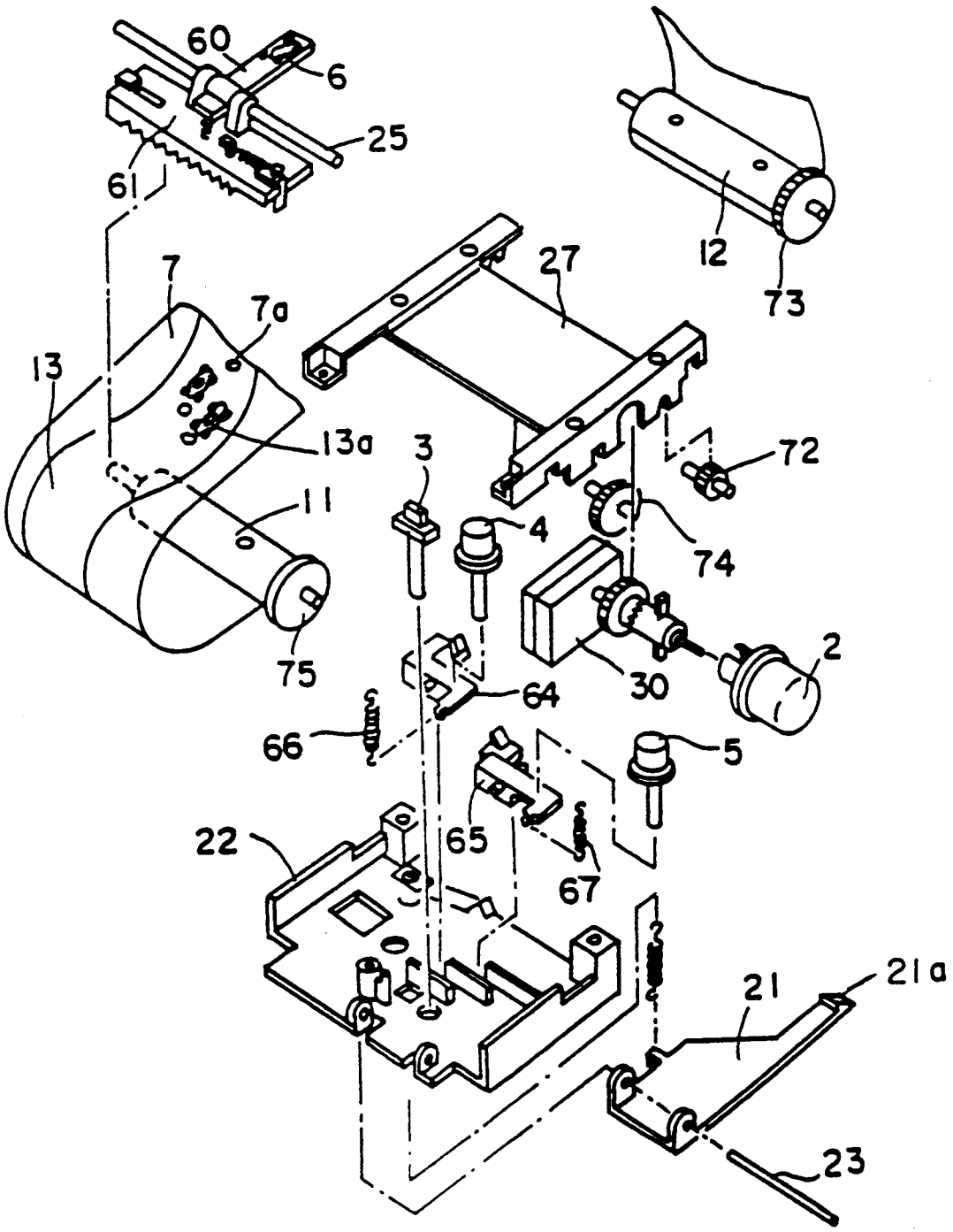
FIG. 7 is an exploded perspective view showing an internal mechanism of the drive game apparatus of the second preferred embodiment.
Figure 8:
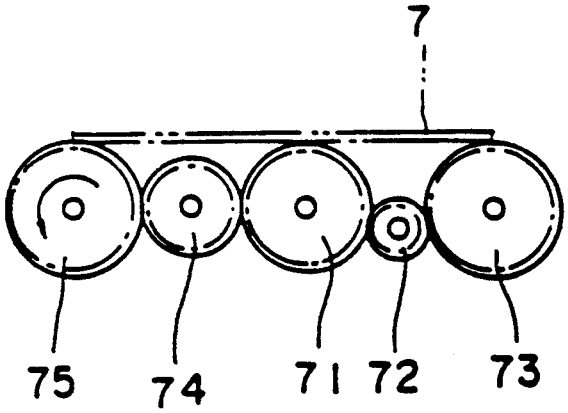
FIG. 8 is a side elevational view showing an engaged state of a gear mechanism of the drive game apparatus of the second preferred embodiment.
Figure 9:
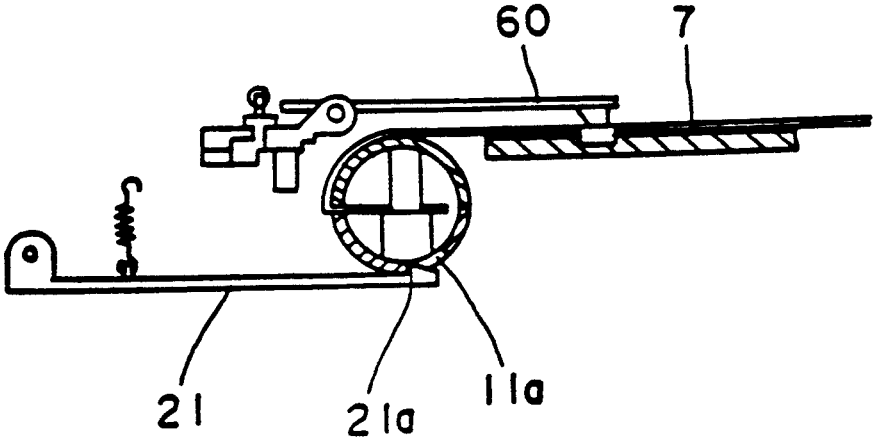
FIG. 9 is a side elevational view partly in section showing an engaged state between a stopper plate and a take-up roll of the drive game apparatus of the second preferred embodiment.

A second preferred embodiment of the present invention is shown in FIGS. 7 to 9. In FIGS. 7 to 9, the same component elements as those shown in FIGS. 1 to 6 are labeled with the same reference numerals. In addition, only the differences between the first and second embodiments will be discussed. A first difference between the drive game apparatus of the second preferred embodiment and the drive game of the first preferred embodiment consists in that a spring (not shown) is mounted within the gear box 30, and the take-up rolls 11 and 12 are rotated concurrently with this spring. That is, as shown in FIGS. 7 and 8, the take-up roller 12 is rotated through a gear 71 arranged in coaxial relationship with the spring, and a small diameter gear 72 and a large diameter gear 73 and at the same time the take-up roll 11 is rotated through the gear 71, the intermediate gear 74 and the large diameter gear 75.

A second difference between the drive game apparatus of the second preferred embodiment and the drive game apparatus of the first preferred embodiment consists in the fact that the stopper plate 21 is not provided with projection 21*a*. This projection 21*a* is merely engaged with a fitting hole 11*a* of the take-up roll 11 to cause a take-up state of the belt-like sheet 7 to be maintained by the take-up roll 12 until a pressing operation of the start button 8 is carried out. In the drive game apparatus of the second preferred embodiment, since the take-up rolls 11 and 12 are rotated through a series of gears, if a rotation of the take-up roll 11 is stopped, the rotation of the other take-up roll 12 is also positively stopped, resulting in preventing the belt-like sheet 7 from unwinding which would be caused by an idling of the other take-up roll 12 when take-up roll 11 is stopped.

Although the preferred embodiments of the present invention have been described above, the present invention is not limited to the aforesaid preferred embodiments, but various modifications can be attained within a scope not departing from the present invention. That is, even though in the aforesaid preferred embodiments, the spring is used as a driving source, a rubber or other driving source may be used. In addition, a motor or the like can also be applied to drive the belt-like sheet. In this case, for example, if a switch for the motor is turned off concurrent with an engagement between the engaging hole 7*a* of the belt-like sheet 7 and the projection 60*a* of the moving member carriage 60, damage of the belt-like sheet 7 from attempting to advance while projection 60*a* is engaged in hole 7*a* can be effectively prevented. In brief, any means capable of moving the belt-like sheet can be applied.

In addition, in the preferred embodiments above, the engaging hole 7*a* of the belt-like sheet 7 and the projection 60*a* of the moving member carriage 60 are engaged to each other. However, the belt-like sheet 7 and the moving member carriage 6 may be engaged using any form of engagement. For example, it may also be available that a U-shaped receiving part can be used in receiving the projection 60*a* at the belt-like sheet 7.

What is claimed is:

1. A drive game apparatus, comprising:

a main body having a window and first and second ends;

first and second take-up rolls having respective first and second shafts connected to the first and second ends;

a flexible sheet having first and second ends, and a surface having obstacles drawn thereon and engaging portions corresponding to the obstacles, said first end connected to said first take-up roll and said second end connected to said second take-up roll, said flexible sheet being visible through the window of said main body;

a driving source connected to one of said first and second shafts, driving said flexible sheet in a direction by rotating the one of the first and second shafts;

a moving member carriage having a frontal planar portion with front and rear opposing surfaces, the front surface being visible through the window of said main body, connected to said main body having a rear surface and a projection disposed on said rear surface, and being biased causing the projection to be in contact with said flexible sheet; and moving member operating means for reciprocating said moving member carriage in a perpendicular direction to the direction which said flexible sheet is driven permitting the projection to be inserted into one of said engaging portions.

2. A drive game apparatus as in claim 1, wherein said main body includes a speed changing button cavity and a speed changing button disposed in said speed changing button cavity, and wherein said drive game apparatus further comprises speed changing means activated by the speed changing button for varying the speed of said flexible sheet driven by said driving source.

3. A drive game apparatus as in claim 2, wherein said speed changing means comprises gears used for increasing and decreasing the speed of said flexible sheet driven by said driving source.

4. A drive game apparatus as in claim 1, wherein said first and second take-up rolls are rotated using a series of gears.

5. A drive game apparatus, comprising:

a main body having a window and first and second ends;

first and second take-up rolls having respective first and second shafts connected to the first and second ends;

a flexible sheet having first and second ends, and a surface having obstacles drawn thereon and engaging portions corresponding to the obstacles, said first end connected to said first take-up roll and said second end connected to said second take-up roll, said flexible sheet being visible through the window of said main body, said first and second take-up rolls and said flexible sheet forming a unitary game cartridge whereby said drive game apparatus accommodates game cartridges which are inserted into said drive game apparatus for playing different games;

a driving source connected to one of said first and second shafts, driving said flexible sheet in a direction by rotating the one of the first and second shafts;

a moving member carriage connected to said main body having a rear surface and a projection disposed on said rear surface, and being biased causing the projection to be in contact with said flexible sheet; and moving member operating means for reciprocating said moving member carriage in a perpendicular direction to the direction which said flexible sheet is driven permitting the projection to engage one of said engaging portions.

6. A drive game apparatus, comprising:

a main body having a window and first and second ends;

first and second take-up rolls having respective first and second shafts connected to the first and second ends;

a flexible sheet having first and second ends, and a surface having obstacles drawn thereon and engaging portions corresponding to the obstacles, said first end connected to said first take-up roll and said second end connected to said second take-up roll, said flexible sheet being visible through the window of said main body;

a driving source connected to one of said first and second shafts, driving said flexible sheet in a direction by rotating the one of the first and second shafts;

a moving member carriage connected to said main body having a rear surface and a projection disposed on said rear surface, and being biased causing the projection to be in contact with said flexible sheet;

moving member operating means for reciprocating said moving member carriage in a perpendicular direction to the direction which said flexible sheet is driven permitting the projection to engage one of said engaging portions; and a supporting plate having a lateral elongated rectangular concave groove permitting the projection of said moving member carriage to be inserted after the projection has been inserted in the engaging portion.

7. A drive game apparatus, comprising:

a main body having a window and first and second ends;

first and second take-up rolls having respective first and second shafts connected to the first and second ends;

a flexible sheet having first and second ends, and a surface having obstacles drawn thereon and engaging portions corresponding to the obstacles, said first end connected to said first take-up roll and said second end connected to said second take-up roll, said flexible sheet being visible though the window of said main body;

a driving source connected to one of said first and second shafts, driving said flexible sheet in a direction by rotating the one of the first and second shafts;

a moving member carriage connected to said main body having a rear surface and a projection disposed on said rear surface, and being biased causing the projection to be in contact with said flexible sheet, said projection comprising a first surface perpendicular to the rear surface of said moving member carriage, and a second surface having a gradual incline with respect to the rear surface of said moving member carriage; and moving member operating means for reciprocating said moving member carriage in a perpendicular direction to the direction which said flexible sheet is driven permitting the projection to engage one of said engaging portions.

8. A drive game apparatus, comprising:

a main body having a window and first and second ends;

first and second take-up rolls having respective first and second shafts connected to the first and second ends;

a flexible sheet having first and second ends, and a surface having obstacles drawn thereon and engaging portions corresponding to the obstacles, said first end connected to said first take-up roll and said second end connected to said second take-up roll, said flexible sheet being visible through the window of said main body;

a driving source connected to one of said first and second shafts, driving said flexible sheet in a direction by rotating the one of the first and second shafts;

a moving member carriage connected to said main body having a rear surface and a projection disposed on said rear surface, and being biased causing the projection to be in contact with said flexible sheet;

moving member operating means having a sliding member which has teeth for reciprocating said moving member carriage in a perpendicular direction to the direction which said flexible sheet is driven permitting the projection to engage one of said engaging portions; and a fixing plate having claws, the teeth of the sliding member engaging said claws.

9. A drive game apparatus, comprising:

a main body having a window and first and second ends;

first and second take-up rolls having respective first and second shafts connected to the first and second ends;

a flexible sheet having first and second ends, and a surface having obstacles drawn thereon and engaging portions corresponding to the obstacles, said first end connected to said first take-up roll and said second end connected to said second take-up roll, said flexible sheet being visible through the window of said main body;

a driving source connected to one of said first and second shafts, driving said flexible sheet in a direction by rotating the one of the first and second shafts, said driving source comprising a motor having a switch which turns said motor off when the projection is engaged with one of the engaging portions;

a moving member carriage connected to said main body having a rear surface and a projection disposed on said rear surface, and being biased causing the projection to be in contact with said flexible sheet; and moving member operating means for reciprocating said moving member carriage in a perpendicular direction to the direction which said flexible sheet is driven permitting the projection to engage one of said engaging portions.

10. A drive game apparatus, comprising:

a main body having a window and first and second ends;

first and second take-up rolls having respective first and second shafts connected to the first and second ends;

a flexible sheet having first and second ends, and a surface having obstacles drawn thereon and engaging portions corresponding to the obstacles, said first end connected to said first take-up roll and said second end connected to said second take-up roll, said flexible sheet being visible through the window of said main body;

a driving source connected to one of said first and second shafts, driving said flexible sheet in a direction by rotating the one of the first and second shafts, said driving source comprising a spring connected to one of said first and second take-up rolls;

a moving member carriage connected to said main body having a rear surface and a projection disposed on said rear surface, and being biased causing the projection to be in contact with said flexible sheet; and moving member operating means for reciprocating said moving member carriage in a perpendicular direction to the direction which said flexible sheet is driven permitting the projection to engage one of said engaging portions.

* * * * *